US005404774A

United States Patent [19]

Bond

[11] Patent Number: 5,404,774

[45] Date of Patent: Apr. 11, 1995

[54] CLUTCH ADJUSTING TOOL

[75] Inventor: Nicholas P. Bond, Fort Wayne, Ind.

[73] Assignee: Dana Corporation, Toledo, Ohio

[21] Appl. No.: 85,532

[22] Filed: Jun. 30, 1993

[51] Int. Cl.[6] ..... B25B 13/06

[52] U.S. Cl. ..... 81/180.1; 81/121.1; 81/185.2; 81/484; 7/164

[58] Field of Search ..... 81/119, 121.1, 180.1, 81/184, 185.2, 484; 7/100, 138, 164

[56] References Cited

U.S. PATENT DOCUMENTS 1,332,351 3/1920 Murray ..... 81/121.1
1,390,071 9/1921 Wetzstein .
1,544,520 6/1925 Putrow .
2,184,340 12/1939 Ferlin .
2,200,453 5/1940 Lizakowski .
2,313,174 3/1943 Shock .
2,464,058 3/1949 Rogers .
4,953,680 9/1990 Flotow et al. .
5,230,263 7/1993 Kwaka ..... 81/180.1
5,307,713 5/1994 White ..... 81/180.1

*Primary Examiner*—D. S. Meislin
*Attorney, Agent, or Firm*—Dykema Gossett PLLC

[57] ABSTRACT

A tool used for manually adjusting the spacing between disks of a friction clutch includes a handle, and a bolt engaging end. The tool further includes a spacer assembly for providing a clearance above a bolt head and for applying the necessary pressure to maintain a clutch in engagement when rotating the bolt to provide adjustment.

10 Claims, 1 Drawing Sheet

CLUTCH ADJUSTING TOOL

BACKGROUND OF THE INVENTION

This invention relates to a tool used to manually adjust the distance between a clutch plate and a friction disc in a clutch. More specifically, the invention relates to a tool that provides a fixed clearance above an adjusting bolt head, and simultaneously provides means to maintain the clutch in engagement during the adjustment.

Clutches having a clutch plate and friction disc which are manually adjustable in response to wear on friction surfaces are well known. In some instances, manual adjustment is achieved by rotation of an adjusting bolt head on the outer housing of the clutch. The rotation of the adjusting bolt head, in turn, decreases the spacing between the clutch plate and friction disc. In clutch designs that incorporate a release mechanism above the adjusting bolt head, rotation of the adjusting bolt can be difficult. Typically, such rotation of the adjusting bolt is achieved by a conventional boxed end wrench. Prior to adjustment, the clutch is engaged, and a bar is inserted to maintain engagement of the clutch and to provide clearance for the boxed end wrench. The process is difficult, and time consuming.

The object of the present invention is to provide a single tool for rotating of the adjusting bolt head while simultaneously providing clearance above the adjusting bolt head so that the clutch plate is maintained in engagement with the friction disc.

SUMMARY OF THE INVENTION

In a preferred embodiment of the present invention, a clutch adjusting tool includes a handle having a fastener engaging surface at one end, preferably a boxed end. A resilient bracket is secured to the handle, wherein a portion of the bracket extends over the boxed end. An aperture in the bracket is generally co-axial with the aperture of the boxed end of the tool. A rigid, cylindrical spacer extends through the aperture in the bracket. First and second ends of the spacer prevent removal from the aperture of the bracket. The rigid spacer is movable axially through the aperture, and is adapted to provide a clearance when the tool is placed over the head of a bolt.

These and other features of the present invention can be best understood from the following specification and drawings, of which the following is a brief description.

DETAILED DESCRIPTION OF THE PREFERRED EMBODIMENT

Figure 1:
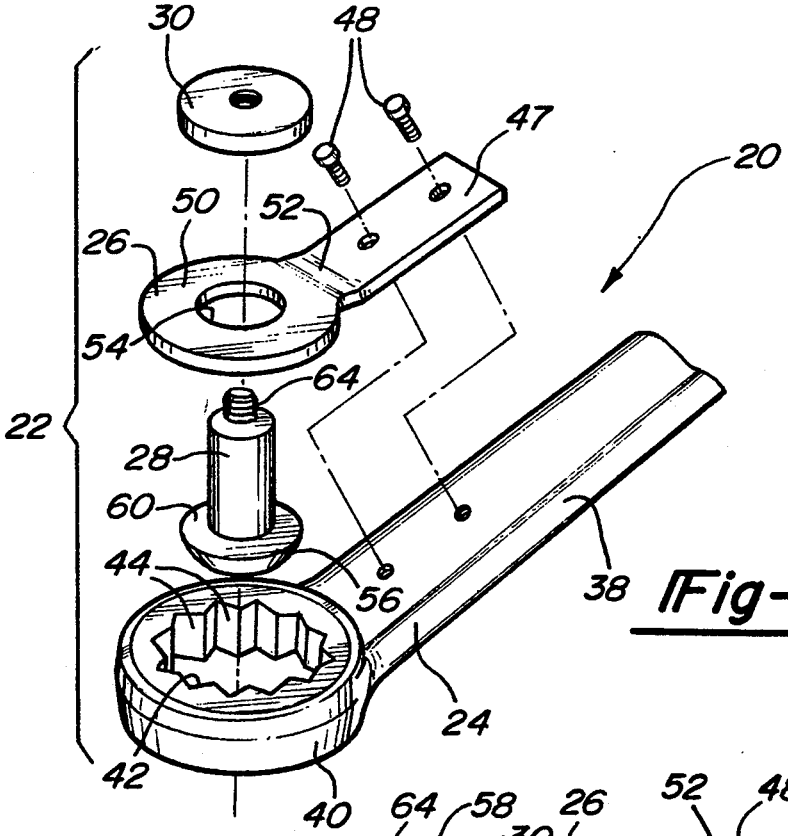
FIG. 1 is an exploded isometric view of a clutch adjusting tool according to the present invention.

Referring now to the drawings, FIG. 1 illustrates a clutch adjusting tool 20, including a spacer assembly 22. Tool 20 is formed from a conventional boxed end wrench 24 which is adapted to include the spacer assembly 22. Any conventional wrench or specially designed wrench head and handle which fits the head of a fastener that is being adjusted can be used. Spacer assembly 22, comprised of a bracket 26, a spacer 28 and a washer 30, provides a fixed clearance above the head 32 of a bolt 34 during rotation of the bolt about an axis 36 (illustrated in FIG. 3).

Figure 3:
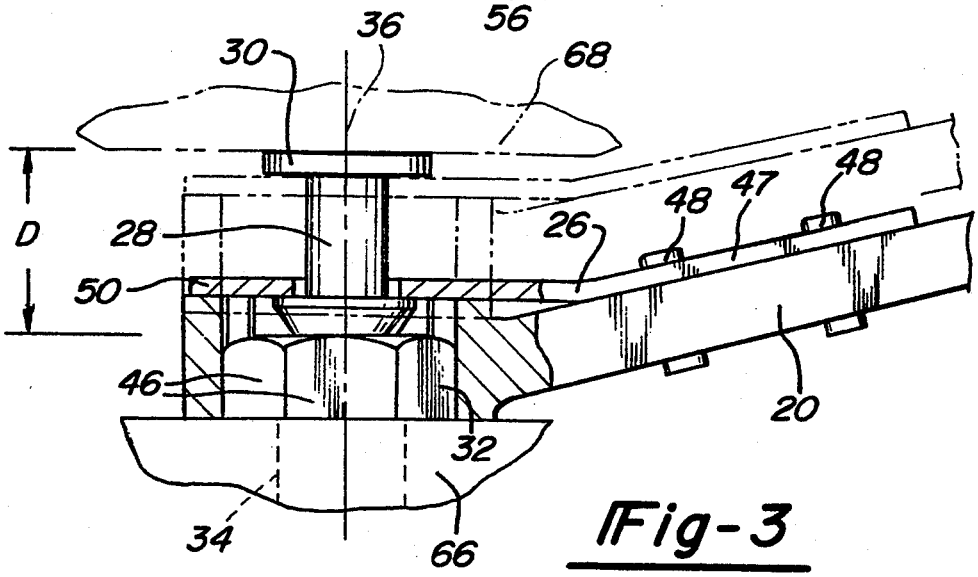
FIG. 3 is an environmental view of the clutch adjusting tool as used to adjust a clutch.

Referring now to the Figures, tool 20 includes a handle 38, and a boxed end 40 serving as a bolt engaging device. Boxed end 40 includes aperture 42 defining a plurality of flats 44, as shown in FIG. 1. Flats 44 are adapted to engage flats 46 of bolt head 32, as shown in FIG. 3.

Figure 2:
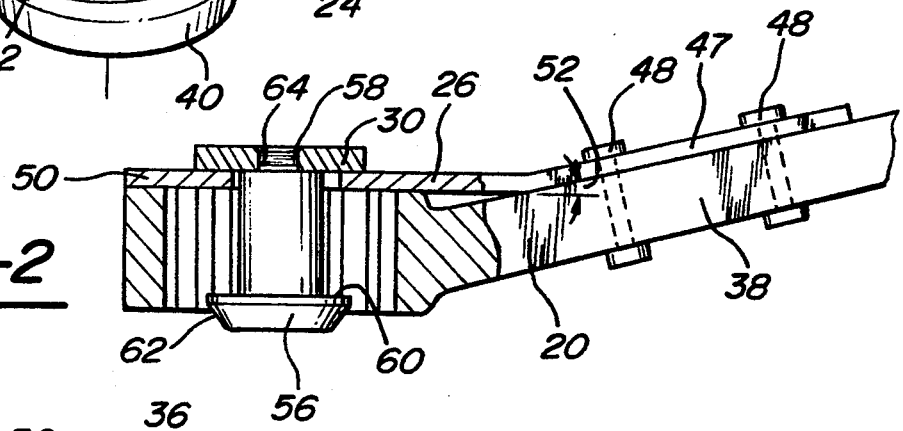
FIG. 2 is a partial cross-sectional view of the clutch adjusting tool.

Illustrated in FIGS. 1 and 2, an arm 47 of bracket 26 is secured to handle 38 by a plurality of fasteners, preferably rivets 48. A hoop portion 50 of bracket 26 extends over boxed end 40, and is angled with respect to arm 47, shown at 52, to conform to the curvature of handle 38. Bracket 26 is formed of a resilient material, such as spring metal, and secured to handle 38 such that a slight bend can occur as necessary during use. Portion 50 of bracket 26 includes a circular aperture 54 generally concentric with aperture 42 of boxed end 40.

Spacer 28 is preferably cylindrical and formed of a rigid material, such as metal. Spacer 28 extends along axis 36, and includes a first end 56 and a second end 58. First end 56 defines a shoulder portion 60 having a diameter greater than the diameter of aperture 54 of bracket 26. Outer circumferential edge 62 of first end 56 is preferably chamfered or beveled allowing tool 20 to be smoothly inserted over bolt head 32 during use.

Second end 58 of spacer 28 includes a threaded portion 64 to receive washer 30. Washer 30 is disk-shaped and is adapted to be threadably received on threaded portion 64. Alternatively, washer 30 may be press fit on portion 64. During assembly of tool 20, spacer 28 is first inserted through aperture 54 of bracket 26 prior to threading washer 30 on threaded portion 64. Spacer 28 is contained within aperture 52 between the enlarged first and second ends 54 and 56.

Referring now to FIG. 3, the inventive tool 20 has valuable applications when used to manually adjust the spacing between a clutch plate and a friction disc in a clutch (none of which are shown). The clutch plate and friction disc require adjustment after wear has occurred on the friction surfaces, such as friction linings on the disc. In such a clutch, the head 32 of adjusting bolt 34 extends axially from the outer housing 65 of the clutch. An axially cycling release mechanism 68 is positioned above bolt head 32 such that only limited space is provided for clearance to use tool 20. While the clutch is engaged, release mechanism 68 is positioned axially away from bolt head 32 providing clearance for tool 20. Spacer 28 of tool 20 is positioned between bolt head 32 and release mechanism 68 while bolt 34 is rotated. Spacer 28 is dimensioned to extend a fixed axial distance to provide the necessary clearance D (as shown in FIG. 3) above bolt head 32 when tool 20 is in use.

In operation, the clutch is first placed in engagement which positions release mechanism 68 away from bolt head 32. Tool 20 is then placed over bolt 34 and spacer 28 inserted over bolt head 32. The clutch may then be partially disengaged to provide a force directly on spacer 28 of tool 20. Even though the boxed end 40 of the tool engages and rotates bolt head 32, spacer 28 will remain in a fixed position to provide clearance D above bolt head 32. Thus, boxed end 40 may be rotated independently of spacer 28. Spacer 28 operates to prevent release mechanism 68 from moving axially toward bolt head 32, and thus maintains the clutch in engagement. Spacer 28, once positioned over bolt head 32, provides sufficient clearance D so that boxed end 40 can be axially disengaged from the head, rotated above the head, and re-inserted onto the head, all without removal of tool 20. The clutch plate and friction disc, however, can only be disengaged after tool 20 has been removed.

A preferred embodiment of the present invention has been disclosed. A worker of ordinary skill in the art will recognize, however, that modifications of the disclosed embodiment will fall within the scope of this invention. For that reason, the following claims should be studied to determine the true scope and content of this invention.

What is claimed is:

1. A tool for accessing a fastener located adjacent a closely positioned member, said tool comprising:

a fastener engaging means, for operatively engaging said fastener; and a spacer means, attached to said fastener engaging means, for spacing the closely positioned member from the fastener, said spacer means including a bracket and a spacer, said bracket having an aperture and being secured to said tool, said spacer extending through said aperture, said spacer having first and second ends, said ends maintaining said spacer within said aperture of said bracket, wherein said spacer provides a clearance above the fastener.

2. A tool for rotating a fastener, said tool providing a clearance above the fastener, said tool comprising:

a handle;

a fastener engaging means attached to said handle, said engaging means adapted to engage the fastener head;

a bracket secured to at least one of said engaging means or said handle, said bracket extending over said engaging means, said bracket having an aperture;

a spacer extending through said aperture, said spacer having first and second ends, said ends said ends having a diameter greater than the diameter of said aperture of said bracket to maintain said spacer within said aperture of said bracket, said spacer being movable along an axis extending through said aperture, wherein said spacer provides the clearance above the fastener head as the fastener is rotated.

3. A tool as recited in claim 2, wherein said spacer is movable along said axis a distance defined by the spacing between said first and second ends.

4. A tool as recited in claim 2, wherein said spacer rotates about said axis independently of said engaging means.

5. A tool as recited in claim 2, wherein said first end of said spacer includes a shoulder portion, said shoulder portion having a diameter greater than the diameter of said aperture of said bracket.

6. A tool as recited in claim 2, wherein said first end of said spacer includes a chamfered outer circumferential edge.

7. A tool as recited in claim 2, wherein said second end of said spacer is provided with a washer, said washer being threadably received upon said spacer, said washer having a diameter greater than the diameter of said aperture of said bracket.

8. A tool as recited in claim 2, wherein said second end of said spacer is provided with a washer, said washer being press fit upon said spacer, said washer having a diameter greater than the diameter of said aperture of said bracket.

9. A tool as recited in claim 2, wherein said bracket is formed of a resilient material, and said bracket is secured to said handle by securing means, said securing means being spaced from said fastener engaging means, whereby said bracket is movable axially above said engaging means.

10. A tool as recited in claim 2, wherein said engaging means is a boxed end, said boxed end being generally circular and having a plurality of flats for engaging the fastener head, said aperture of said bracket being generally co-axial with said boxed end.

* * * * *

UNITED STATES PATENT AND TRADEMARK OFFICE

CERTIFICATE OF CORRECTION

PATENT NO. : 5,404,774

DATED : April 11, 1995

INVENTOR(S) : Nicholas P. Bond

It is certified that error appears in the above-indentified patent and that said Letters Patent is hereby corrected as shown below:

Column 3, line 38, delete the second occurrence of "said ends".

Signed and Sealed this

Thirteenth Day of June, 1995

*Attest:*

*Attesting Officer*

Bruce Lehman

BRUCE LEHMAN

*Commissioner of Patents and Trademarks*